US005512061A

United States Patent [19]

von der Eltz et al.

[11] Patent Number: 5,512,061

[45] Date of Patent: Apr. 30, 1996

[54] PRINTING AND DYEING OF TEXTILES (INVERSE RESIST PRINTING)

[75] Inventors: Andreas von der Eltz; Andreas Schrell, both of Frankfurt am Main; Werner H. Russ, Flörsheim, all of Germany

[73] Assignee: Hoechst Aktiengesellschaft, Frankfurt am Main, Germany

[21] Appl. No.: 204,773

[22] Filed: Mar. 2, 1994

[30] Foreign Application Priority Data

Mar. 2, 1993 [DE] Germany ..... 43 06 432.9

[51] Int. Cl.[6] ..... D06P 5/12; D06P 3/62; D06P 3/66

[52] U.S. Cl. ..... 8/480; 8/485; 8/499; 8/543; 8/572; 8/576; 8/587; 8/542; 8/604; 8/606; 8/650; 8/918; 8/930; 8/448

[58] Field of Search ..... 8/446, 448, 449, 8/455, 458, 463, 587, 576, 466, 480, 485, 499, 572, 602, 604, 606, 188, 189, 190, 196, 181, 930, 542, 918, 673, 680

[56] References Cited

U.S. PATENT DOCUMENTS

| | | | |
|---|---|---|---|
| 2,108,836 | 2/1938 | Whitehead | 8/448 X |
| 4,711,640 | 12/1987 | Harper, Jr. | 8/481 |
| 4,743,266 | 5/1988 | Harper, Jr. | 8/181 |
| 4,988,365 | 1/1991 | Sternberger | 8/602 |

FOREIGN PATENT DOCUMENTS

| | | |
|---|---|---|
| 1463682 | 4/1974 | Canada . |
| 2084585 | 6/1993 | Canada . |
| 2106893 | 9/1993 | Canada . |
| 0513656 | 11/1992 | European Pat. Off. . |
| 18-253 | 1/1943 | Japan . |
| 56-037389 | 4/1981 | Japan . |
| 479341 | 2/1938 | United Kingdom . |

OTHER PUBLICATIONS

Bayer et al "Methoden der organische Chemie" (Houben--Weyl), Band VI/2', no month available 1963.

Beckert et al "Methoden der organische Chemie" (Houben--Weyl), Band E11, no month available 1985.

Journal of Applied Polymer Science, vol. 21, 1977 no month available, "Grafting of Cyclic Carbonates onto Cotton and Modified Cottons".

Baasner et al "Method der organische Chemie" (Houben--Weyl), Band E4, no month available 1983.

Smith, B. et al, *Text. Chem. Color* 19:23–29 (Aug. 1987).

Graham, L. A., *Text. Chem. Color* 21:27–32 (Jun. 1989).

*Primary Examiner*—Margaret Einsmann

*Attorney, Agent, or Firm*—Connolly and Hutz

[57] ABSTRACT

A process for printing and dyeing sheetlike fiber materials with anionic dyes comprises a) first applying to the sheetlike fiber material an aqueous solution containing a fixing alkali and a compound which contains a primary, secondary or tertiary amino group or a quaternary ammonium group, which may each also be part of a heterocycle, by using a printing process, then b) subjecting the sheetlike fiber material to a fixing treatment to modify the sheetlike fiber material, and finally and optionally c) dyeing the modified sheetlike fiber material one or more times by a customary exhaust or padding method.

12 Claims, No Drawings

PRINTING AND DYEING OF TEXTILES (INVERSE RESIST PRINTING)

It is known that cellulose fiber textiles such as woven or knitted fabrics can be printed with anionic dyes by various methods. A fundamental distinction is made between direct printing; indirect, or resist, printing; and discharge printing. In discharge printing the dye is locally destroyed (discharged), while resist printing gets its name from the colorless material, the resist, which is applied to mechanically or chemically prevent (resist) fixation in whole or part. If a dye is added to the resist, for example a vat dye, it is referred to as a colored resist; if not, it is called a white resist.

Of late the conventional dyeing methods of printing, exhaust dyeing and padding have been joined by a modern spray technique which under the name of inkier printing was applied first to paper, but later also to textiles. The inkier printing process is the only one of the non-contact printing processes which makes it possible to produce colored images quickly, quietly and in high resolution. The process is usually carried out with aqueous inks, which are sprayed as small droplets directly onto the substrate (paper, textile). There is a continuous form of the process, in which the ink is pressed at a uniformrate through a nozzle and the jet is directed onto the paper, or into an ink collector, by an electric field depending on the pattern to be printed, and there is an interrupted inkjet or drop-on-demand process, in which the ink is expelled only where a colored dot is to appear, the latter form of the process employing a piezoelectric crystal or a heated hollow needle (bubble or thermal jet process) to exert pressure on the ink system and so eject an ink droplet (Text. Chem. Color., 19(8), 23–29; Text. Chem. Color. 21(6), 27–32) .

It is an object of the present invention to provide an economically and ecologically favorable process for printing and dyeing sheetlike fiber materials with exhaust or padding dyes to produce single- or multi-colored cloth.

This object is achieved by first pretreating and modifying the sheetlike fiber material, preferably cellulose fiber material, by application of a compound which contains a primary, secondary or tertiary amino group or a quaternary ammonium group, which amino/ammonium groups may also be part of a heterocycle, by employing a printing process, preferably the inkier spray technique or some other non-contact minimal addon spray technique, and subsequently dyeing the modified material one or more times by the exhaust or padding method.

The present invention accordingly provides a process for printing and dyeing sheetlike fiber materials with anionic dyes, which comprises a) first applying to the sheetlike fiber material an aqueous solution containing a fixing alkali and a compound which contains a primary, secondary or tertiary amino group or a quaternary ammonium group, which may each also be part of a heterocycle, by using a printing process, preferably the inkier spray technique or some other minimal addon spray technique, then b) subjecting the sheetlike fiber material to a fixing treatment to modify the sheetlike fiber material, and finally and optionally c) dyeing the modified sheetlike fiber material one or more times by a customary exhaust or padding method.

Fiber material for the purposes of the present invention comprehends natural and synthetic fiber materials containing hydroxyl and/or carboxamide groups, such as silk, wool and other animal hairs and also synthetic polyamide fiber materials and polarurethane fiber materials, for example nylon-4, nylon-6 and nylon-11, and in particular fiber materials with α,β-glucose as the basic structural unit, such as cellulose fiber materials, for example, cotton hemp, jute and linen, and their regenerated derivatives, such as filament viscose and staple viscose, or mixtures thereof, as long as the fiber material is in the form of a sheetlike structure (piece material), such as woven or knitted fabric.

The dyeing method of the invention can be carried out with all water-soluble, preferably anionic, dyes, which preferably have one or more sulfo and/or carboxyl groups and may if desired contain fiber-reactive groups. As well as to the class of the fiber-reactive dyes they may belong to the class of the azoic dyes, to the class of the direct dyes, to the class of the vat dyes and to the class of the acid dyes, which can be for example azo dyes, copper complex, cobalt complex and chromiumcomplex azo dyes, copper and nickel phthalocyanine dyes, anthraquinone, copper formazan and triphendioxazine dyes. Such dyes have been numerously described in the literature, for example in EP-A-0 513 656, and are entirely familiar to the person skilled in the art.

Alkalis for the purposes of the present invention include for example alkali metal hydroxide, alkali metal carbonate or alkali metal bicarbonate, the alkali metal being preferably sodium or potassium, and also those compounds which develop an alkaline effect only in their fixing conditions, for example alkali metal trichloroacetate, alkali metal acetate, alkali metal formate, alkali metal fluoride, alkali metal citrate, alkali metal tartrate, alkali metal malonate and alkali metal oxalate, the alkali metal being preferably lithium, sodium or potassium, in particular sodium trichloroacetate, sodium formate, sodium citrate, potassium citrate, sodium tartrate, sodium oxalate and potassium fluoride. It is also possible to use a mixture of the alkali salts mentioned.

The concentration of the alkali in the aqueous solution is from 0.1 to 30% by weight, preferably from 5 to 20% by weight. Generally the fixing pH will be between 10 and 14, the attainable pH for the alkali metal carboxylates being from 8 to 10.

As well as the pretreating substance and the alkali the aqueous solution may additionally contain further customary additives, for example printing thickeners such as alginates, carob bean flour ether, vegetable gum or starch derivatives.

Contemplated printing processes are relief printing, roller printing, hand screen printing, flat screen printing, rotary screen printing, hand block printing, spray printing, brush printing, Orbis printing, yarn printing, warp printing and preferably inkjet printing.

The pretreatments mentioned can be fixed on the fiber by hot steam, dry heat, microwaves, radiowaves or some other suitable energy transfer method. If heat is used, the temperatures are advantageously between 60° and 230° C., preferably between 90° and 190° C. The duration of this heat treatment is about 20 seconds to 6 minutes in hot air, about 3 to 20 minutes in saturated steam (102° C.) and about 2 to 15 minutes in superheated steam (130° C.).

The modified fiber material is aftertreated by rinsing with cold and hot water and optionally by treatment in an aqueous bath containing a small amount of an acid, such as acetic acid, to remove the alkali from the fiber material and subsequent drying.

The pretreated fiber material is then exhaust or pad dyed. For example, the material is dyed blue in a dyeing vessel using a hot dye solution at 60° C. The dyed material is removed after 30 to 60 minutes and boiled with a soap solution. Only the pretreated areas will have been colored blue. In addition it is then possible to subject the partly blue material to a further dyeing process, in which case the dye solution contains the customary salts and alkalis for dyeing. If the selected dye is for example yellow, the non-pretreated areas will be yellow and the blue areas will then be cross-dyed green. The result is consequently a green pattern on a yellow ground.

The process of the invention has the advantage that single-colored patterns do not put salt into the waste water, the neutral-pH dyeing solutions are concentratable ad infinitum, and no printing dyes are required. The dyeings obtained in light and deep shades are brilliant with good color strength. Different depths of the same hue are very simple to achieve with the inkier process, for instance by controlling the amount of the pretreatment liquor applied, for example by repeatedly overprinting the same line, or else by screening and printing a fine dot pattern which with present-day inkier printers can have a resolution above 400 dpi, depending on the process. Without making up a fresh batch of the pretreatment liquor it is thus possible to obtain a multiplicity of color intensities (color saturations).

The compounds contemplated for pretreating and modifying the sheetlike fiber material are in particular compounds conforming to the formulae (1), (2), (3) and (4)

$$H_2N-(CH_2)_k-OSO_3M \quad (1)$$

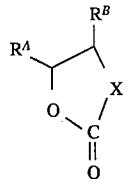
(2)

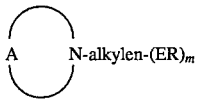
(3)

$$(B)_p-\underset{\underset{(OH)_n}{|}}{alk}-(ER)_m \quad (4)$$

where

M is a hydrogen atom or an alkali metal, such as sodium, potassium or lithium, k is 1 or 2, preferably 2, $R^A$ is hydrogen or alkyl of 1 to 3 carbon atoms which may be substituted by hydroxyl or a group of the formula (5a) or (5b)

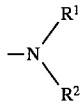
(5a)

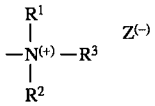
(5b)

where $R^1$ is hydrogen, methyl or ethyl, $R^2$ is hydrogen, methyl or ethyl, and $R^3$ is hydrogen, methyl or ethyl, or $R^1$ and $R^2$ together with the nitrogen atom are a saturated heterocyclic radical formed from one alkylene radical of 5 to 8 carbon atoms or two alkylene radicals of 1 to 4 carbon atoms and an oxygen atom or an amino group of the formula -NH-, for example N-piperazinyl, N-piperidinyl or N-morpholinyl, and $Z^{(-)}$ is an anion, for example chloride, hydrogensulfate or sulfate, $R^B$ has one of the meanings of $R^A$, X is a group -O- or -NH-, ER is an ester group, A and N together with one or two alkylene groups of 1 to 4 carbon atoms form the bivalent radical of a heterocyclic ring, preferably of a 5- or 6-membered heterocyclic ring, for example of the piperazine, piperidine or morpholine ring, wherein A is an oxygen atom or a group of the formula (a), (b) or (c)

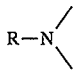
(a)

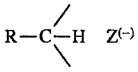
(b)

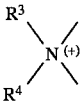
(c)

where

R is a hydrogen atom or an amino group or is an alkyl group of 1 to 6 carbon atoms, preferably of 1 to 4 carbon atoms, which may be substituted by 1 or 2 substituents selected from the group consisting of amino, sulfo, hydroxyl, sulfato, phosphato and carboxyl, or is an alkyl group of 3 to 8 carbon atoms, preferably of 3 to 5 carbon atoms, which is interrupted by 1 or 2 hetero groups selected from -O- and -NH- and may be substituted by an amino, sulfo, hydroxyl, sulfato or carboxyl group, $R^3$ is hydrogen, methyl or ethyl, $R^4$ is hydrogen, methyl or ethyl, and $Z^{(-)}$ is an anion, for example, chloride, hydrogen sulfate or sulfate, B is the amino group of the formula $H_2N$- or an amino or ammonium group of the formula (d) or (e)

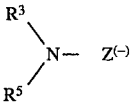
(d)

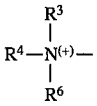
(e)

where $R^3$, $R^4$ and $Z^{(-)}$ are each as defined above, $R^5$ is methyl or ethyl, and $R^6$ is hydrogen, methyl or ethyl, p is 1 or 2, preferably 1, alkylen is a straight-chain or branched alkylene radical of 2 to 6 carbon atoms, preferably of 2 to 4 carbon atoms, which may be substituted by 1 or 2 hydroxyl groups, or is a straight-chain or branched, preferably straight-chain, alkylene radical of 3 to 8 carbon atoms, preferably of 3 to 5 carbon atoms, which is interrupted by 1 or 2 hetero groups selected from -O- and -NH-, alk is a straight-chain or branched alkylene radical of 2 to 6 carbon atoms, preferably of 2 to 4 carbon atoms, or is a straight-chain or branched, preferably straight-chain, alkylene radical of 3 to 8 carbon atoms, preferably of 3 to 5 carbon atoms, which is interrupted by 1 or 2 hetero groups selected from -O- and -NH- and is preferably a straight-chain or branched alkylene radical of 2 to 6 carbon atoms, preferably of 2 to 4 carbon atoms, m is 1 or 2, preferably 1, n is from 1 to 4, preferably I or 2, and the amino, hydroxyl and ester groups in the compounds (3) and (4) may be bonded to a primary, secondary or tertiary carbon atom of the alkylene radical.

Preferably only one of the radicals $R^A$ and $R^B$ is an alkyl group having a group of the formula (5a) or (5b).

The alkyl, alkenyl and alkylene radicals mentioned for the above symbols can be straight-chain or branched. The individual symbols can be identical to or different from each other, within their given definition.

Usable compounds (1), (2), (3) and (4) according to the invention include for example β-sulfato-ethylamine, 2-oxo-1,3-oxazolidine, 4-aminomethyl-2-oxo- 1,3 -oxazolidine, 5-aminomethyl-2 -oxo-1,3 -oxazolidine, 4-(trimethylammoniomethyl)-2-oxo-1,3-oxazolidine chloride, 5- (trimethylammoniomethyl)-2-oxo-1,3-oxazolidine chloride, 1-(trimethylammoniomethyl)ethylene carbonate chloride, N-(β-sulfatoethyl)piperazine, N-[β-(β'-sulfatoethoxy)ethyl] piperazine, N-(γ-sulfato-β -hydroxypropyl) piperidine, N-(γ-sulfato-β-hydroxypropyl)pyrrolidine, N-(β-sulfatoethyl)piperidine, the salts of 3-sulfato-2-hydroxy-1-(trimethylammonium) propane, such as 3-sulfato-2-hydroxy-1-(trimethylammonium) propane sulfate, 2 -sulfato-3 -hydroxy-1-aminopropane, 3- sulfato-2-hydroxy-1-aminopropane, 1- sulfato- 3-hydroxy-2-aminopropane, 3-hydroxy-1-sulfato-2-aminopropane, 2,3-disulfato-1-aminopropane and 1,3 -disulfato- 2-aminopropane and also derivatives of these compounds having another ester group instead of the sulfato group, such as the phosphato group, an alkanoyloxy group of 2 to 5 carbon atoms, such as acetyloxy, p-tosyloxy and 3,4,5 - trimethylphenylsulfonyloxy.

The usable compounds (2) according to the invention can be prepared by known procedures as described numerously in the literature (see Houben-Weyl, Methoden der Organischen Chemie, 4th edition, volume E4, pages 82 to 88 and 192 ff.), for instance by reacting an alkanediol which has a latent nitrogen-containing functional group in the side chain with phosgene in aqueous solution at a pH between 7 and 9 to prepare the hetero-cycloaliphatic carbonates or for example by reacting aminoalkanols with phosgene in aqueous solution to form the heterocycloaliphatic carbamic acid compounds (2-oxo- 1,3-oxazolidines).

Compounds (1) can be prepared in a similar manner by esterifying the corresponding alcohols with sulfuric acid.

The usable compounds (3) and (4) according to the invention can be prepared by esterifying their corresponding hydroxyl-containing compounds in a conventional manner by reaction with the acids or the corresponding acylating agents, although, if an amino-containing compound having more than one hydroxyl group is used, preferably only one of these hydroxyl groups is esterified. These procedures are known in the literature; the preparation of the compounds usable according to the invention can be carried out in a manner similar to those known procedures. For instance, Houben-Weyl, Methoden der Organischen Chemie, volume VI/2, pages 452 to 457, and volume E11, pages 997 ff., describe the esterification of aminoalcohols to their sulfuric esters. Further widely used modifications of such procedures are based on for example stirring the aminoalcohol into a large excess of fuming sulfuric acid (see Chem. Ber..51, 1160) or on the use of inert solvents which serve as the esterification medium, in which case the use of equimolar amounts of concentrated sulfuric acid is possible (see DE-C-825 841). Esterifying and acylating agents which can be used as starting compounds for preparing the ester and amino-containing compounds usable according to the invention include for example sulfuric acid, phosphoric acid, polyphosphoric acid, lower alkanecarboxylic acids and their chlorides or anhydrides, for example (glacial) acetic acid and acetic anhydride, benzenesulfonic acid and the benzenesulfonic acids substituted in the benzene ring by substituents selected from the group consisting of sulfo, carboxyl, lower alkyl, lower alkoxy and nitro, or their sulfonyl chlorides. For example, the sulfato compounds can be prepared from the corresponding hydroxy compounds by introducing the hydroxy compounds into the required amount, i.e. preferably equimolar amount, of concentrated sulfuric acid and stirring at a temperature between 5° and 30° C. for some time until dissolution is complete. They are isolated from the sulfuric acid solution by pouring the solution onto ice and neutralizing, by precipitating the sulfate ions by means of calcium carbonate as calcium sulfate and subsequently filtering and evaporating the aqueous solution. Taking the sulfato compounds as examples, the products obtained are crystalline or semicrystalline and can be used directly in the process for modifying the fiber material. In addition to the compounds of the formulae (1), (2), (3) and (4) there are also certain silanes, disclosed in EP-A-0 513 656, which are suitable for use as pretreatments for the process of the invention. If such silanes are used as pretreatment, no alkali is included in the aqueous pretreatment solution and the fixation is carried out with superheated steam. The concentration of said pretreatments in the aqueous solution is generally between 1 and 20% by weight, preferably between 5 and 10% by weight.

The dyeings obtainable according to the invention on modified cellulose fiber materials require, as mentioned earlier, no further aftertreatment after the dye has been fixed on the substrate, in particular no complicated aftertreatment process involving a wash. If necessary at all, it is sufficient to rinse the dyed substrate as usual one or more times with warm or hot and if necessary cold water which may contain a nonionic wetting agent or a fiber-reactive aftertreating agent, for example condensation products of one mole of cyanuric chloride and two moles of 4-(β-sulfatoethylsulfonyl)aniline, of equivalent amounts of cyanuric chloride, 4-(β-sulfatoethylsulfonyl)aniline and 4,8-disulfo-2-aminonaphthalene or of equivalent amounts of cyanuric chloride, 4-sulfoaniline and 4,8-disulfo-2-aminonaphthalene. The use of a fiber-reactive aftertreatment is advisable when the fiber material modified according to the invention was dyed only to pale depths of shade or the dye used did not possess satisfactory fiber reactivity. In these cases there are still a sufficient number of dyeing-active sites present on the modified fiber, which are capable of reacting for example with other dyes in these dye-contaminated rinse baths. This aftertreatment will deactivate the still active sites on the fiber modified according to the invention, and the originally desired bright dyeing is obtained even in the case of a rinse water which has been used in a technical process and is contaminated with dyes. In addition, a boiling treatment of the dyed substrate with a wash solution to improve the fastness properties is not necessary.

The present invention also provides a sheetlike fiber material printed and dyed by the process of the invention.

The Examples which follow serve to illustrate the invention. Parts and percentages are by weight. Parts by weight bear the same relation to parts by volume as the kilogram to the liter.

EXAMPLE 1

A bleached cotton fabric is flat screen printed with an aqueous print paste containing within 1,000 parts 600 parts of 4% strength thickening consisting of 50 g/l of alginate and 5 g/l of a water softener, 50 parts of N-(2-sulfatoethyl)piperazine, 50 parts of sodium hydroxide and 300 parts of water. The printed fabric is first dried at 60° to 80° C. and then steamed with saturated steam at 102° C. for 10 minutes. The invisible print pattern is then washed at 80° C. for 5 minutes to remove excess alkali and thickener.

The fabric thus pretreated is then exposed in a ratio of 10:1 to an aqueous dye liquor containing 2% (based on the weight of the fabric) of an electrolyte-containing dye of the formula (known from Example 3 of German Offenlegungsschrift No. 2 557 141)

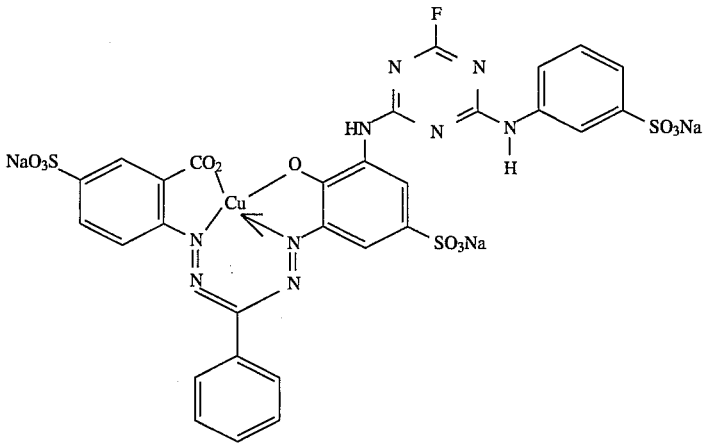

at 60° C. for 30 minutes. After the dyeing process has ended, the fabric is rinsed, briefly soaped at 60° C. and rinsed once more. The result is a cloth which has been dyed blue only in the area where the print pattern is situated.

To achieve further color effects the fabric is then dyed for example by a conventional exhaust method with the electrolyte-containing dye of the formula (known from European Patent 158 233, Example 1)

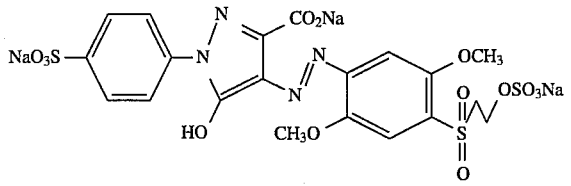

at 60° to 80° C. with the addition of the otherwise customary salt and alkali quantities. Following conventional finishing of the dyeing the result is a cotton fabric which has been dyed a brilliant yellow color in the ground and green in the print pattern and has good in-service fastness properties.

EXAMPLE 2

A mercerized and bleached cotton fabric is pattern printed for example on an inkier flat bed printer by exclusive movement of the printing head according to a commercially available graphics program using an aqueous solution containing in 1,000 parts 100 parts of N-(2-sulfatoethyl)piperazine and 75 parts of sodium hydroxide. The fabric is then subjected to saturated steam fixing at 102° C. for 10 minutes. The cotton is thoroughly rinsed with water, soaped if necessary at 80° C., rinsed once more and then dyed as described under Example 1 using, however, a dye of the formula

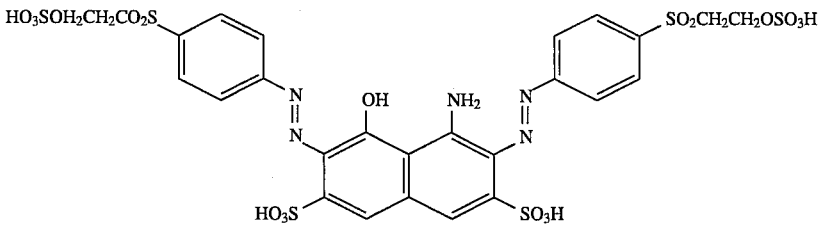

in a 6% strength solution in a liquor ratio of 10:1 (based on the weight of the textile). After the dyed material has been boiled off, only the pattern has a bluish black color. The ground dyeing is carried out with the dye of the formula

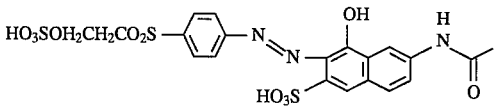

(in the form of the alkali metal salt) known from European Patent Application Publication No. 0 061 151. The print pattern thus appears deep black and the ground orange.

In this way it is possible to produce complicated patterns of color on a piece of textile knit.

EXAMPLE 3

A bleached cotton fabric is printed (for example rotary screen printed) with an aqueous solution which within 1,000 parts contains 100 parts of N-(2-sulfatoethyl)piperazine, 200 parts of sodium formate and 650 parts of water. The printed fabric is steamed with hot steam at 30° C. for 8 minutes. The invisible print pattern is then washed at 80° C. for 5 minutes to remove excess alkali. The fabric thus pretreated is then exposed in a ratio of 10:1 to an aqueous dye liquor containing 2% (based on the weight of the fabric) of an electrolyte-containing dye of the formula (known from Example 2 of German Offenlegungsschrift No. 1 179 317)

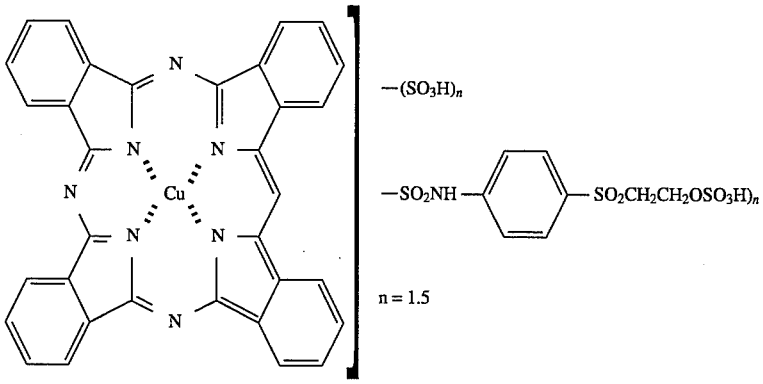

at 60° C. for 30 minutes. After the dyeing process has ended, the fabric is rinsed, briefly soaped at 60° C. and rinsed once more. The result is a cloth which has been dyed a turquoise blue color only in the area where the print pattern is situated.

To achieve further color effects the fabric is then dyed, for example by customary exhaust method, with the a electrolyte-containing dye of the formula

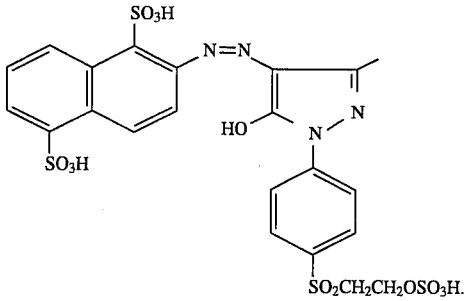

The result is a brilliant green pattern on yellow ground with high in-service fastness properties.

EXAMPLE 4

A bleached and mercerized cotton fabric is inkier printed with an aqueous solution containing within 1,000 parts 100 parts of 2-oxo-1,3-oxazolidine, 200 parts of sodium citrate and 650 parts of water. The printed fabric is fixed with hot air at 160° C. for 5 minutes. The invisible print pattern is then washed at 80° C. for 5 minutes to remove excess alkali.

The fabric thus pretreated is then exposed in the ratio 10:1 to an aqueous dye liquor containing 3% (based on the weight of the fabric) of an electrolyte-containing dye of the formula (known from EP Offenlegungsschrift 0 144 766, Example 5)

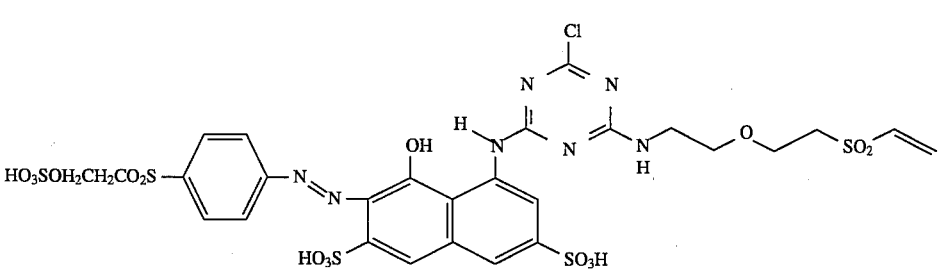

at 60° C. for 30 minutes. After the dyeing process has ended, the fabric is rinsed, briefly soaped at 60° C. and rinsed once more. The result is a cloth which has been dyed red only in the area where the print pattern is located.

To achieve further color effects the fabric is then dyed, for example by a conventional exhaust method, with 1% (in a liquor ratio of 10:1, based on the weight of the fabric) of the electrolyte-containing dye of the formula (known from DE-A-1 943 904)

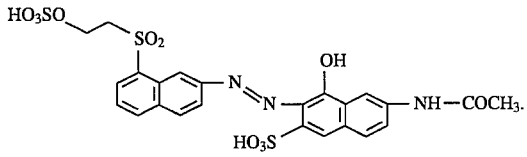

The result is a red print on a red ground of different hue.

EXAMPLE 5

A bleached and mercerized cotton fabric is printed with an aqueous solution which within 1,000 parts contains 100 parts of 2-oxo-1,3-oxazolidine, 200 parts of sodium trichloroacetate and 650 parts of water by introducing the pretreatment liquor into an ink cartridge of a commercial inkier printer and then inkjet printing this solution. Commercial programs are used to create patterns and these are sprayed onto the textile via the printer. The printed fabric is fixed with hot air at 160° C. for 5 minutes. The invisible print pattern is then washed at 80° C. for 5 minutes to remove excess alkali. The fabric thus pretreated is then exposed in a ratio of 10:1 to an aqueous dye liquor containing 6% (based on the weight of the fabric) of an electrolyte-containing dye of the following formula:

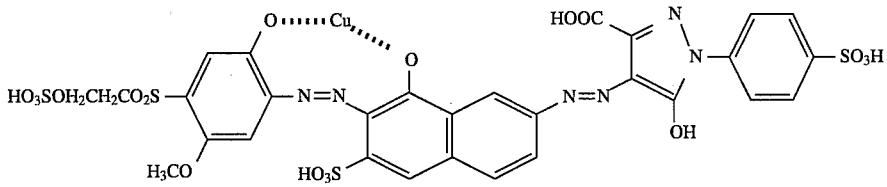

at 60° C. for 30 minutes. After the dyeing process has ended, the fabric is rinsed, briefly soaped at 60° C. and rinsed once more. The result is a cloth which has been dyed black only in those areas where the print pattern is located. The dyeing liquor is replenished with dye and is ready for the next dyeing. To achieve further color effects the fabric is then dyed, for example by a customary exhaust method, with 2% (in a liquor ratio of 10:1, based on the fabric weight) of the electrolyte-containing dye of the formula (known from Swiss Patent Application Publication CH 350 390)

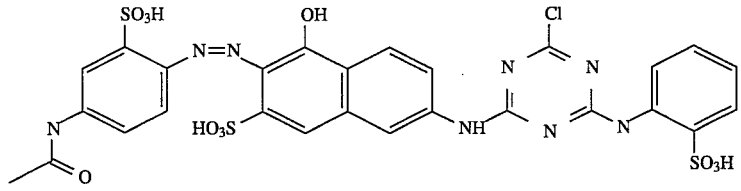

The result is a deep black print on a brilliant red ground (scarlet).

EXAMPLES 6 to 16

Dyeings are prepared in a similar manner to the preceding examples using the following dyes:

| Ex. | Dye used (in the form of the alkali metal salt) | Hue |
|---|---|---|
| 6 | 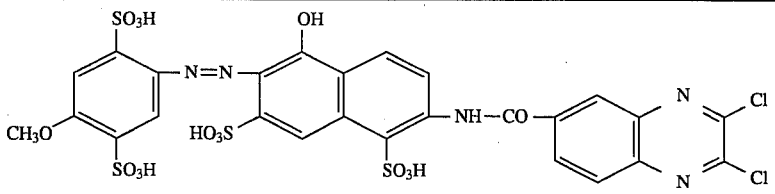 (known from DE-A-1 813 438, Ex. 1) | scarlet |
| 7 | 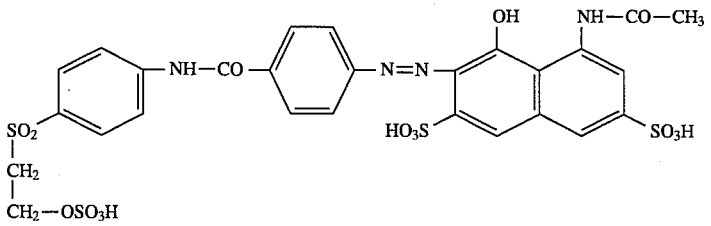 (known from DE-B-1 126 647) | red |
| 8 | 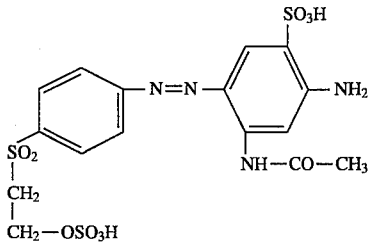 (known from EP-B-0 073 481) | yellow |
| 9 | 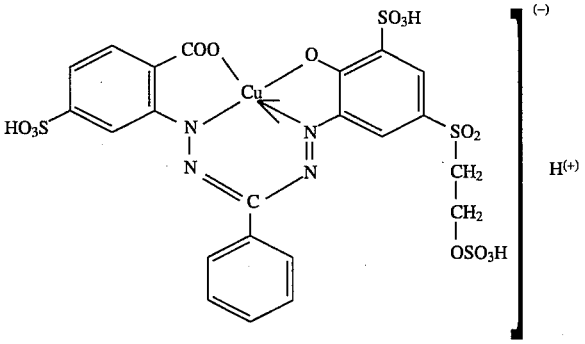 (known from EP-B-0 028 788) | blue |
| 10 | 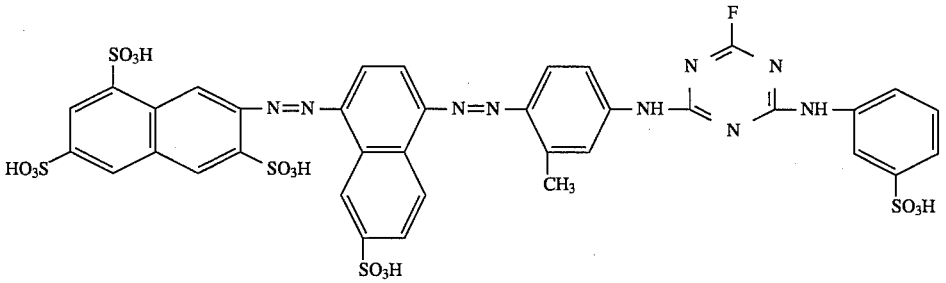 (known from DE-A-2 733 109, Ex. 2) | reddish brown |

-continued
| Ex. | Dye used (in the form of the alkali metal salt) | Hue |
|---|---|---|
| 11 | 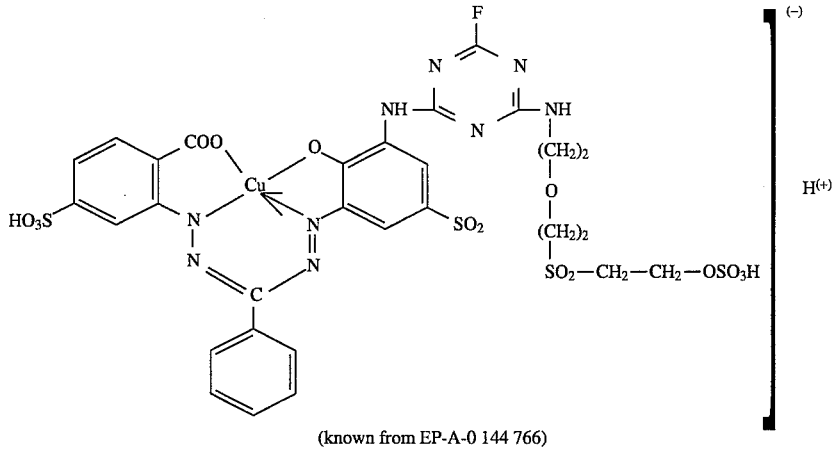 (known from EP-A-0 144 766) | blue |
| 12 | 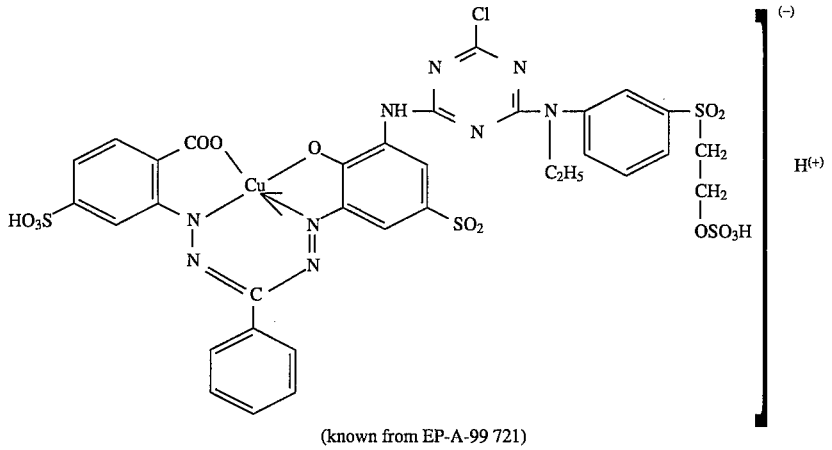 (known from EP-A-99 721) | blue |
| 13 | 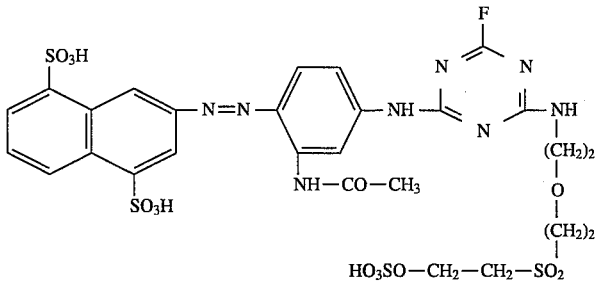 (known from EP-A-0 457 715) | yellow |
| 14 | 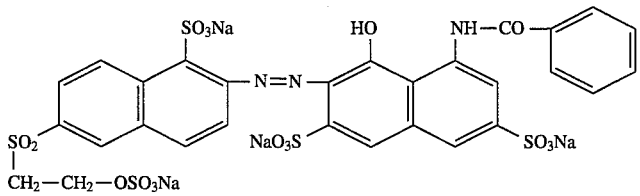 (known from EP-A-0 158 233, Ex. 3) | red |

-continued

| Ex. | Dye used (in the form of the alkali metal salt) | Hue |
|---|---|---|
| 15 | 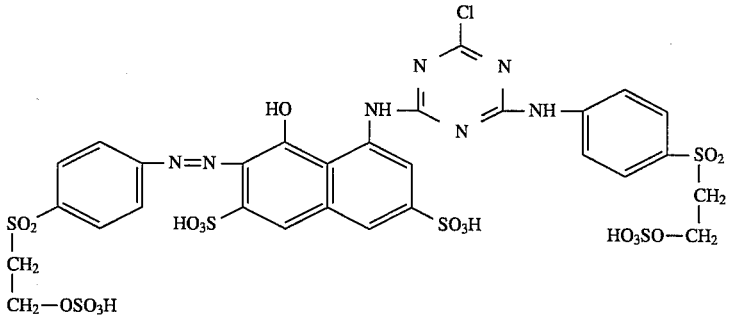 (known from EP-B-0 094 055) | red |
| 16 | 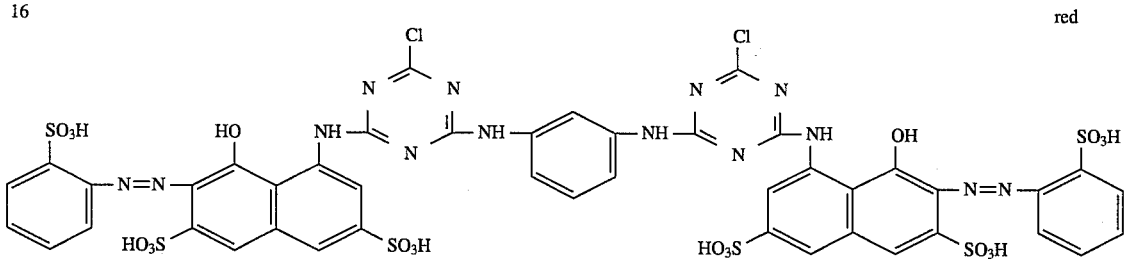 (known from DE-A-2 001 960) | red |

What is claimed is:

1. A process for the production of colored patterns on areas of cellulose fiber sheet material, which comprises the steps of:

printing onto the areas of said material an aqueous solution containing a fixing alkali and a compound of the general formulae (1), (2), (3), or (4)

$$H_2N-(CH_2)_k-OSO_3M \quad (1)$$

(2)

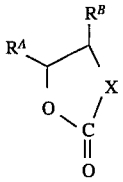

where

M is a hydrogen atom or an alkali metal k is 1 or 2

$R^A$ is hydrogen or alkyl of 1 to 3 carbon atoms which is unsubstituted or substituted by hydroxyl or a group of the formula (5a) or (5b)

(5a)

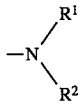

(5b)

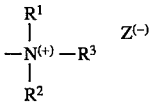

where $R^1$ is hydrogen, methyl, or ethyl, $R^2$ is hydrogen, methyl, or ethyl, and $R^3$ is hydrogen, methyl, or ethyl, or $R^1$ and $R^2$, together with the nitrogen atom, are a saturated heterocyclic radical formed from one alkyl radical of 5 to 8 carbon atoms or two alkylene radicals of from 1 to 4 carbon atoms and an oxygen atom or an amino group of the formula -NH-, and Z is an anion, $R^B$ has one of the meanings of $R^A$, X is a group -O- or -NH-, and, if X is -O-, at least one of $R^A$ and $R^B$ is not hydrogen, (3)

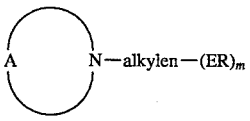

$$(B)_p-\underset{\underset{(OH)_n}{|}}{alk}-(ER)_m \quad (4)$$

where

ER is an ester selected from the group consisting of sulfato, phosphato and $C_2$-$C_5$-alkanoyloxy, A and N together with one or two alkylene groups of 1 to 4 carbon atoms form the bivalent radical of a heterocyclic ring, wherein A is an oxygen atom or a group with the formula (a, (b), or (c)

(a)

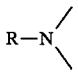

(b)

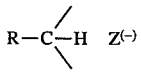

-continued

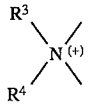

(c)

where

R is a hydrogen atom or an amino group or is an alkyl group of 1 to 6 carbon atoms, which is unsubstituted or substituted by 1 or 2 substituents selected from the group consisting of amino, sulfo, hydroxy, sulfato, phosphato, and carboxyl, or is an alkyl group of 3 to 8 carbon atoms, which is interrupted by 1 or 2 hetero groups selected from -O- and -NH- and is unsubstituted or substituted by an amino, sulfo, hydroxy, sulfato, or carboxyl group, $R^3$ is hydrogen, methyl, or ethyl, $R^4$ is hydrogen, methyl, or ethyl, and Z is an anion, B is the amino group of the formula $H_2N$- or an amino or ammonia group of the formula (d) or (e)

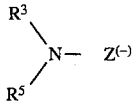

(d)

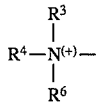

(e)

where $R^3$, $R^4$, and $Z^{(-)}$ are as defined above, $R^5$ is methyl, or ethyl, $R^6$ is hydrogen, methyl, or ethyl, and Z is an anion, p is 1 or 2 alkylen is a straight-chain or branched alkylene radical of from 2 to 6 carbon atoms, which interrupted by 1 or 2 hereto groups selected from -O- and -NH-, alk straight-chain or branched alkylene radical of 2 to 6 carbon atoms, or is a straight-chain or branched alkylene radical of 3 to 8 carbon atoms, which is interrupted by 1 or 2 hetero groups selected from -O- and -NH-, m is 1 or 2, n is from 1 to 4, and the amino, hydroxyl, and ester groups may be bonded to a primary, secondary, or tertiary carbon atom of the alkylene radical, by using a printing process, subjecting the fiber sheet material to a fixing treatment, and dyeing the fiber sheet material in the absence of alkali by an exhaust or padding method.

2. The process as claimed in claim 1, wherein the cellulose fiber sheet material is cotton.

3. The process as claimed in claim 1, wherein the print process used is a non-contact minimum add on spray technique.

4. The process as claimed in claim 1, wherein the print process used is inkjet printing.

5. The process as claimed in claim 1, wherein the compound with which the cellulose fiber sheet material is printed and modified is N-(2-sulfatoethyl)piperazine, 2-oxo- 1,3-oxazolidine or β-sulfatoethylamine.

6. The process as claimed in claim 1, wherein the compound with which the cellulose fiber sheet material is printed and modified is present in the aqueous solution in a concentration between 1 and 20 % by weight.

7. The process as claimed in claim 1, wherein the compound with which the cellulose fiber sheet material is printed and modified is present in the aqueous solution in a concentration between 5 and 10 % by weight.

8. The process as claimed in claim 1, further comprising the step of dyeing the fiber sheet material at least one additional time with a reactive dye, a vat dye, a direct dye, or an acid dye in the presence of alkali and salts.

9. The process as claimed in claim 1, wherein the step of fixing comprises contacting the fiber sheet material with hot air.

10. The process as claimed in claim 9, wherein the hot air is at a temperature of from 60° to 230° C.

11. The process as claimed in claim 9, wherein the fixing with hot air is carried out for 20 seconds to 6 minutes.

12. The process as claimed in claim 1, wherein ER is p-tosyloxy, or 3,4,5-trimethylphenylsulfonyloxy .

* * * * *